US005395290A

United States Patent [19]

Knijpstra

[11] Patent Number: 5,395,290

[45] Date of Patent: Mar. 7, 1995

[54] FAIRGROUND DEVICE

[75] Inventor: Hette Knijpstra, Terband, Netherlands

[73] Assignee: Knijpstra Konstruktie B.V., Terband, Netherlands

[21] Appl. No.: 50,500

[22] PCT Filed: Nov. 4, 1991

[86] PCT No.: PCT/NL91/00218

§ 371 Date: Aug. 23, 1993

§ 102(e) Date: Aug. 23, 1993

[87] PCT Pub. No.: WO92/07638

PCT Pub. Date: May 14, 1992

[30] Foreign Application Priority Data

Nov. 2, 1990 [NL] Netherlands ..... 9002399

[51] Int. Cl.[6] ..... A63G 1/08

[52] U.S. Cl. ..... 472/31; 472/1; 472/29; 297/344.24

[58] Field of Search ..... 472/29, 30, 31, 32, 472/35–44, 36; 297/326, 344.21, 344.24

[56] References Cited

U.S. PATENT DOCUMENTS

| | | | |
|---|---|---|---|
| 1,520,592 | 12/1924 | Mongillo | 472/31 |
| 2,202,543 | 5/1940 | Walker et al. . | |
| 2,211,876 | 4/1940 | Barnard . | |
| 2,294,166 | 8/1942 | Eyerly . | |
| 2,399,332 | 4/1946 | D'Errico . | |
| 2,547,152 | 4/1951 | Burg | 472/1 |
| 2,934,341 | 4/1960 | Shepherd | 472/44 |
| 3,707,282 | 12/1972 | Robinson | 472/1 |
| 3,905,596 | 9/1975 | Barber | 472/31 |
| 4,007,926 | 2/1977 | Ottaway | 472/1 |
| 4,214,790 | 7/1980 | Sieber | 297/326 |

FOREIGN PATENT DOCUMENTS

| | | | |
|---|---|---|---|
| 0082435 | 6/1983 | European Pat. Off. . | |
| 0283872 | 9/1988 | European Pat. Off. . | |
| 0341759 | 11/1989 | European Pat. Off. . | |
| 1603163 | 12/1970 | Germany . | |
| 2331881 | 1/1975 | Germany . | |
| 3431684 | 3/1986 | Germany | 472/1 |
| 7300751 | 7/1973 | Netherlands . | |

*Primary Examiner*—Carl D. Friedman
*Assistant Examiner*—Kien Nguyen
*Attorney, Agent, or Firm*—Griffin, Butler, Whisenhunt & Kurtossy

[57] ABSTRACT

A fairground device having a plurality of seats, a base disc driven for rotation about a central axis and at least one seat support mounted in spaced relation relative to the central axis for rotation about a second axis. Each of the seat supports carry at least one seat mounted eccentrically relative to the corresponding second axis. The seats are mounted on the seat supports for rotation about at least one, third axis which extends substantially transversely to the second axis.

18 Claims, 8 Drawing Sheets

FAIRGROUND DEVICE

This invention relates to a fairground device comprising a base disc driven for rotation about a central axis and a plurality of seat supports mounted in spaced relation relative to the central axis for rotation about a second axis, each of the seat supports carrying a plurality of seats mounted eccentrically relative to the corresponding second axis.

Such a fairground device is known from European patent application 0082435. In this known device, the seats are rotatable about the axis of the associated seat support. During operation of such a device, the passenger simultaneously experiences the sensation caused by the rotation of the base disc and the sensation caused by the seat rotating about the second axis spaced from the central axis of the base disc.

To modify this combination of sensations, which was already known as such, it is proposed in European patent application 0082435 to slightly incline the axis of rotation of the seat supports relative to the central axis of the base disc. As a result, the level of the seat during rotation about the second axis varies.

The shaft of the second axis can be mounted on the base disc as well as on a rotatable intermediate disc mounted on the base disc. Further, the central axis of the base disc of the known device can optionally be slightly inclined.

The object of the invention is to increase the thrill of the sensation aroused by the known devices, i.e. the above-described devices, which may or may not comprise intermediate discs and may or may not be provided with an inclined central shaft and/or an inclined second shaft.

To that end, according to the invention, a fairground device of the type described hereinabove is characterized in that the seats are mounted on the seat supports for rotation about a third axis extending transversely to the second axis.

As will appear from the following, the base disc may alternatively consist of a hub with a plurality of radial arms.

Hereinafter, the invention will be further described with reference to the accompanying drawings of some embodiments. In said drawings.

Figure 1:
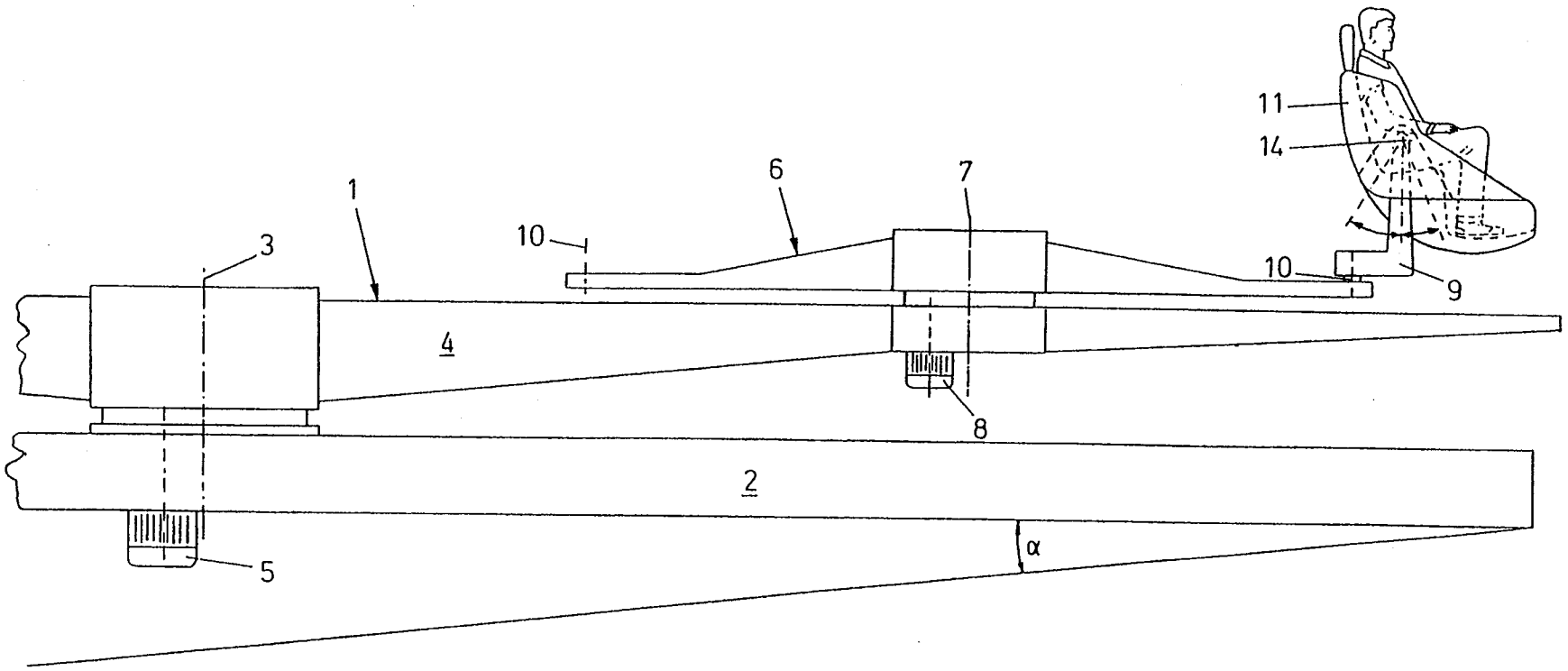
FIG. 1 is a diagrammatic side elevation of a part of a fairground device according to the invention.

FIG. 1 is a diagrammatic view of a fairground device 1, comprising a base plate 2 having a base disc 4 mounted thereon for rotation about an axis 3. The base disc 4 can be driven for rotation about the axis 3 by means of a diagrammatically shown motor 5, which may be an electric motor or a hydromotor.

The base disc can be arranged horizontally but in practice often makes an angle $\alpha$ with the horizontal, as shown in FIG. 1.

In this embodiment, the base disc 4 mounts a plurality of intermediate discs 6 each driven for rotation about an axis 7 by means of a motor 8. Arranged adjacent the perimeter of an intermediate disc 6 are one or more seat supports 9. The seat supports are mounted on the intermediate disc 6 for rotation about an axis 10. The movement of the seat support 9 relative to the intermediate disc 6 may be loose or driven. In this embodiment, the seat support is of L-shaped design, viewed in side elevation, the axis 10 being located adjacent the free end of the short horizontal leg of the L-shaped seat support.

Figure 8:
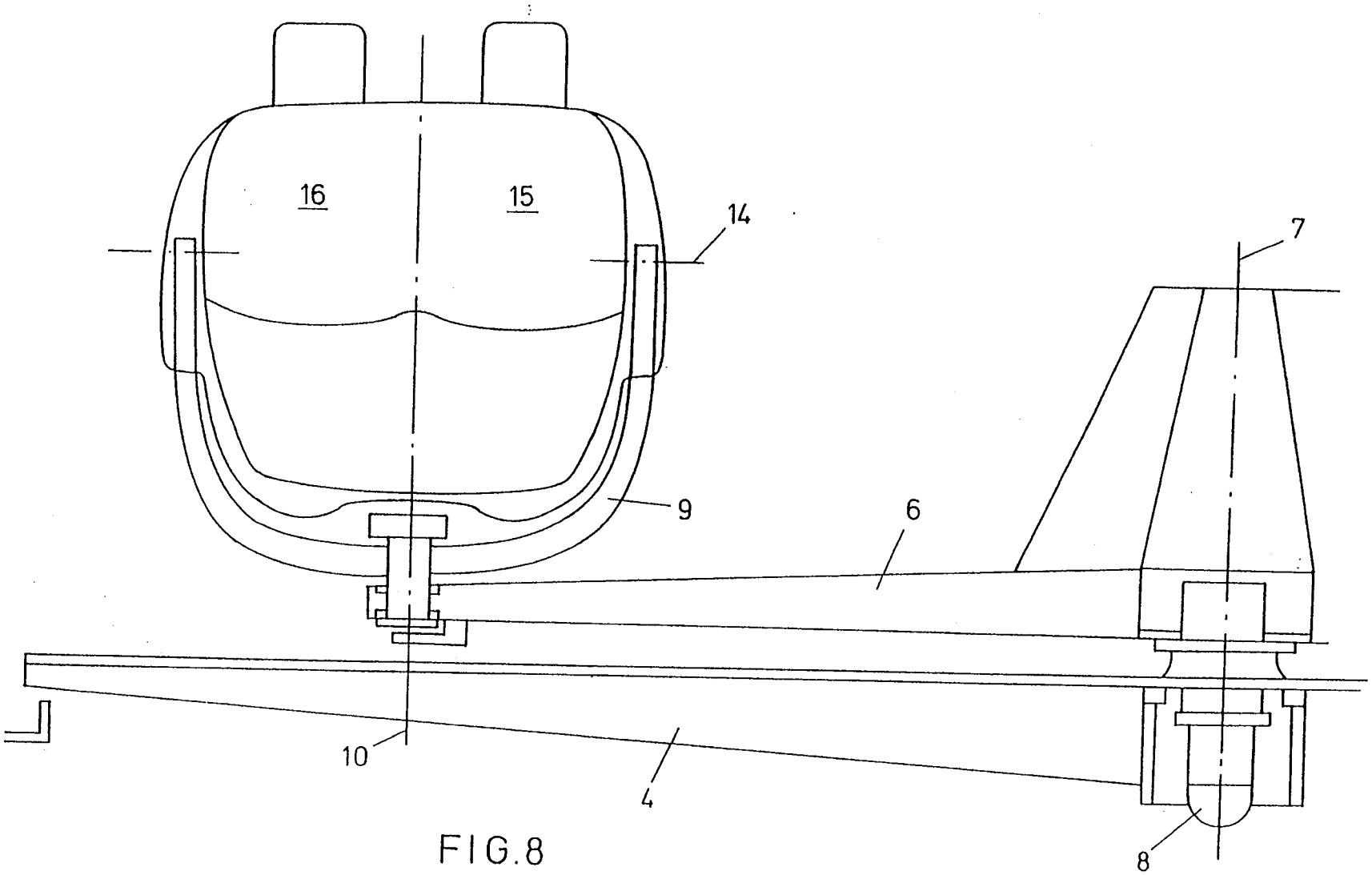
FIGS. 8—12, by way of example, are diagrammatic views of some embodiments of seat supports with associated seat configurations.

The upright leg of the L-shaped seat support may in turn be U-shaped, as shown in FIG. 8, so that a seat 11 can be mounted between the legs thereof. The seat 11 is mounted for rotation relative to a transverse axis 14. Accordingly, the seat 11 can rock and/or rotate about the transverse axis 14. This motion may be loose or driven. The rotation of the intermediate disc can also be loose, if so desired, but it is preferred that it be driven. The seat can comprise one or more seating positions to suit requirements. FIG. 8, for instance, schematically shows a seat having two seating positions 15, 16 in side by side arrangement.

It is also possible to use seat supports mounting oppositely arranged seats, which may each have one or more seating positions in side by side arrangement.

Further, the seats in the embodiment of FIGS. 1–4 are so mounted that the passenger is seated facing away from the horizontal leg of the seat support. However, the seats may also be mounted so that the passenger faces in a direction corresponding to the direction of the horizontal leg.

Figure 11:
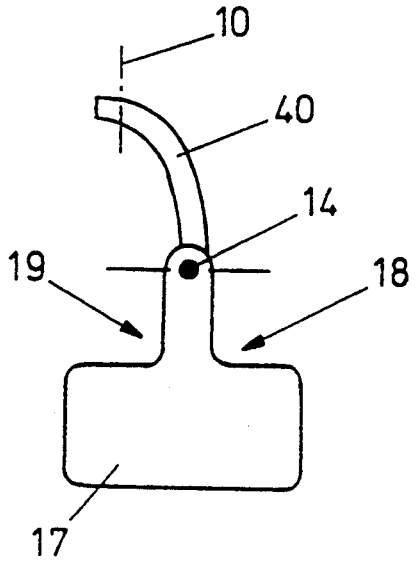

A seat may also have two or more seating positions in back-to-back relationship, such as the seat 17 having seating positions 18, 19 as shown schematically by way of example in FIG. 11. The seat shown in FIG. 11 is further suspended, by way of example, from the end of a depending arm 40 of a seat support. In that case, the seat is suspended from the arm and can rock about the axis 14.

Figure 2:
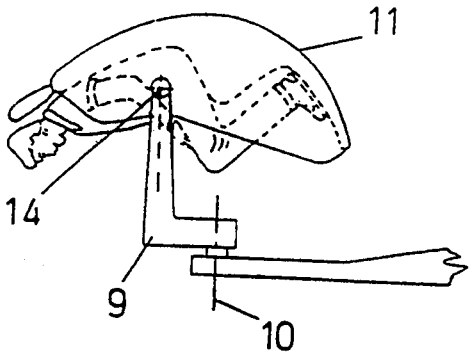
FIGS. 2, 3 and 4 are diagrammatic views of a part of a device according to FIG. 1 in three different positions of the seats during operation.
Figure 3:
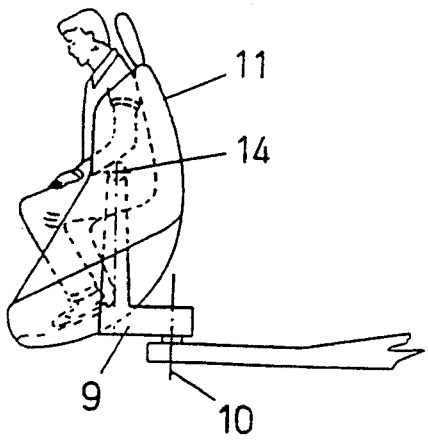
Figure 4:
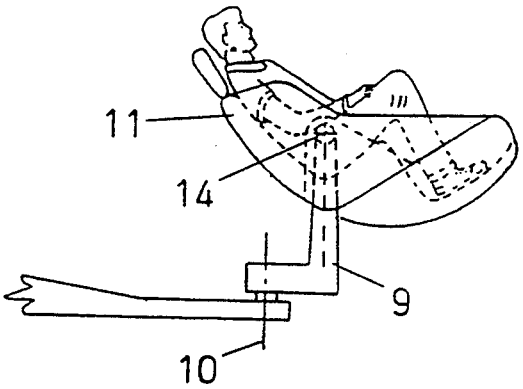

The seat can be mounted in a manner permitting it to rock back and forth only, but it could alternatively be mounted in a manner permitting rotation through 360° in the (substantially) vertical plane, as shown in FIG. 2.

Figure 10:
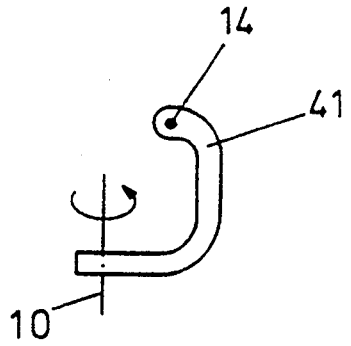
Figure 12:
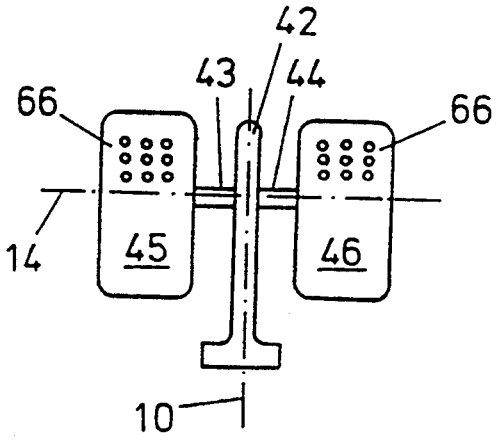

The seat support may be substantially L-shaped in side elevation, as shown in FIG. 1, but may have any other suitable form. A suitable form is the approximately C-shaped design as shown in FIG. 10 at 41. Further, the upper part of the seat support (or the lower part in the case of depending seats) may be U-shaped, as shown in FIG. 8, the seat being mounted between the legs of the U-shape. FIG. 12 is a schematic rear view of another configuration, where the seat support has a central upright arm 42 having projecting transverse arms 43, 44 carrying at least one seat 45, 46 comprising one or more seating positions. The transverse axis about which the seats can rock or rotate is indicated at 14. This axis could optionally be slightly inclined, so that the rocking motion occurs in a plane that is not parallel to the axis of rotation 7 or the axis of rotation 3.

Instead of a base disc or an intermediate disc, a hub fitted with radial arms can be used. If the base disc is designed in that way, the radial arms carry, spaced from the hub, either the seat supports or an intermediate disc which may or may not consist of a "real" disc or a hub with radial arms.

Figure 5:
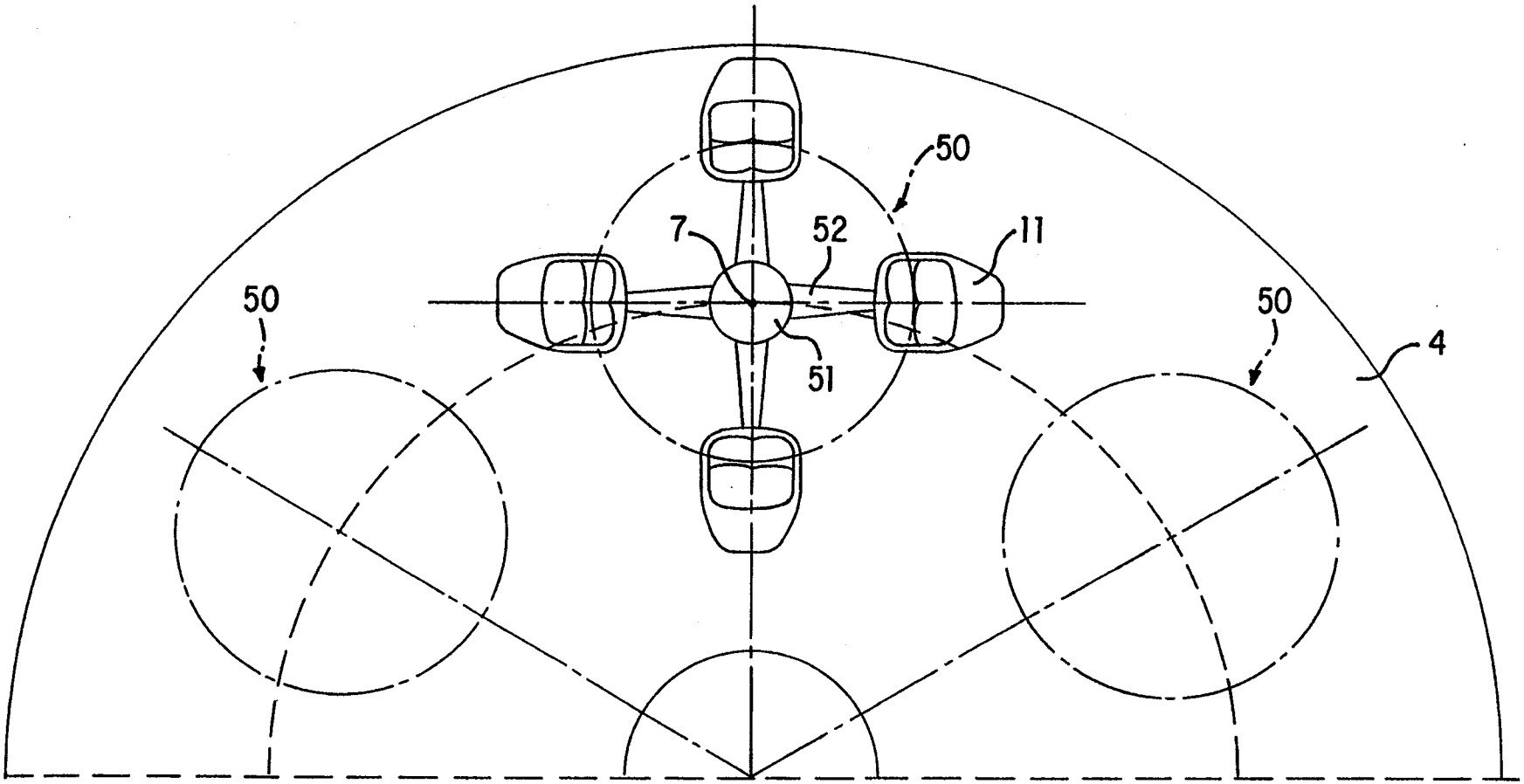
FIG. 5 is a diagrammatic top plan view of a part of a second embodiment of a fairground device according to the invention.

FIG. 5 is a schematic top plan view of an embodiment with a closed base disc 4 (see FIG. 1) and a plurality of intermediate discs 50 each consisting of a hub 51 provided with a plurality of radial arms 52. In the embodiment shown, four radial arms are used, each carrying a seat support 11 with a seat for two persons.

Figure 6:
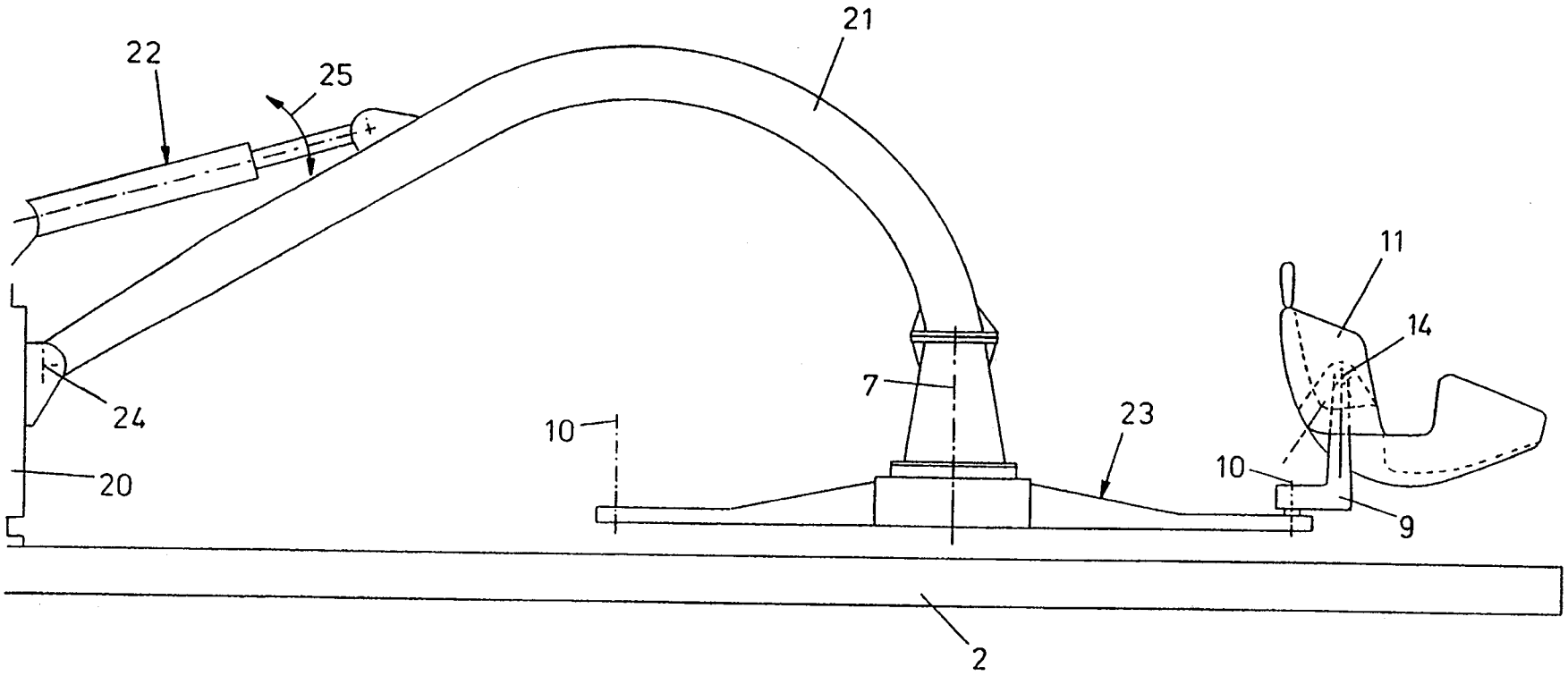
FIG. 6 is a diagrammatic view of yet another variant of a device according to the invention.

FIG. 6 is a schematic view of a part of an embodiment of a fairground device according to the invention, in which, instead of a base disc, a central hub 20 with a plurality of radial arms 21 is used. The radial arms each carry at their free ends an intermediate disc 23 which in turn carries a plurality of seat supports and seats in one of the manners described.

In this embodiment, the radial arms 21 first curve upwards from the central hub 20 while the terminal part of the arms curves downwards again. In this embodiment, the intermediate disc 23, which can be a closed disc or a disc built up from a hub and radial arms, is suspended from the lower free end of an arm 21.

This embodiment shows some resemblance to a known fairground device known in practice under the tradename "Poliep" (Polyp). Examples of such devices are for instance described in European patent application 0341759 and Netherlands patent application 7300751. However, a clear difference between the present and the known devices is the manner in which each seat is mounted.

In the embodiment shown in FIG. 6, the radial arms are further mounted on the central hub for pivotal motion about a transverse axis 24. The position of the radial arm can be set by means of a hydraulic cylinder 22. Optionally, the cylinder can cause the arm to hinge up and down during operation, as is schematically indicated by an arrow 25. It goes without saying that the hub can be slightly inclined.

Further, the intermediate discs 23 could be located higher above the base plate 2 and the seat supports could be suspended from the intermediate disc or mounted on an element rigidly connected to the radial arm. Such a configuration is schematically shown in FIG. 11. FIG. 11 shows a depending end 40 of a seat support, the seat being pivoted to the lower end of the seat support for pivotal motion about a transverse axis 14. This manner of suspension can also be used in a closed base disc. In that case, the intermediate disc must be located relatively far above the base disc or consist of a hub with upwardly curving arms which, in turn, may or may not be movable up and down and which themselves may carry a plurality of eccentrically rotatable seat supports with one or more seats suspended for rocking motion.

In this case, too, therefore, in a manner similar to that used in the devices described hereinabove, by virtue of the freely rotatable arrangement of the seat support and the seat, the user is pressed straight against the seat during operation, so that the motions to which the user is subjected can be qualified as thrilling and yet comfortable.

Figure 7:
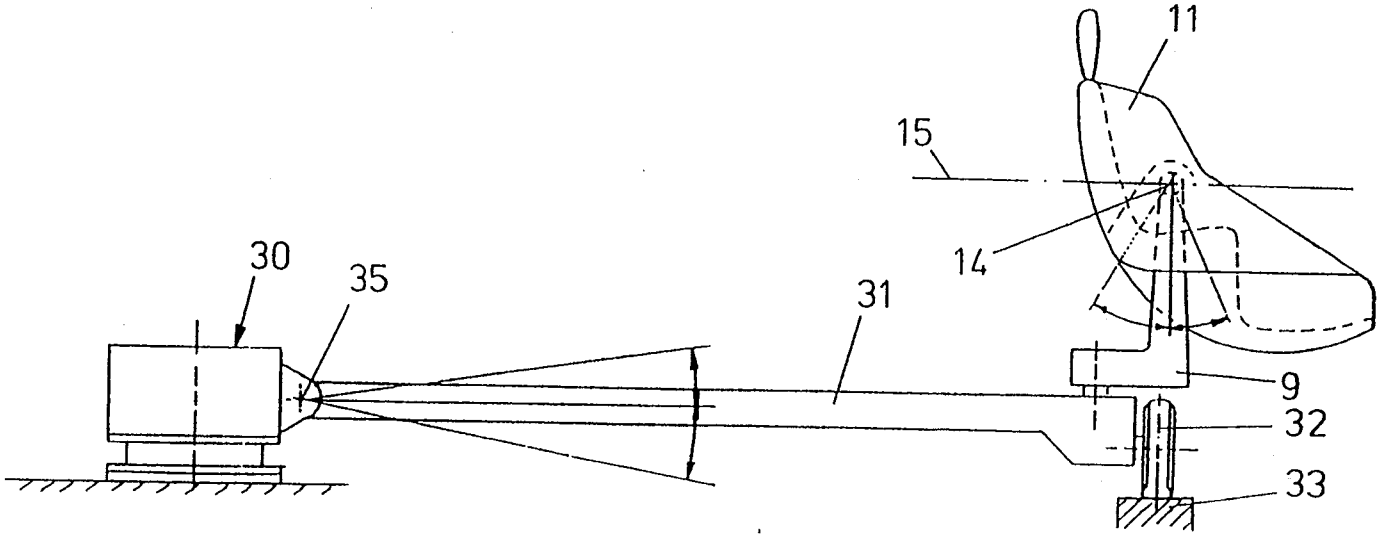
FIG. 7 is a diagrammatic view similar to the view of FIG. 1, of yet another embodiment of a fairground device according to the invention.

FIG. 7 schematically shows an embodiment of a fairground device according to the invention, in which the base disc is built up again from a hub 30 driven for rotation, which may or may not be slightly inclined, provided with radial arms 31 pivoted to the hub at 35. In this embodiment, the radial arms are supported at the ends by one or more rollers or wheels 32 which run over an endless track 33. The track can be planar, but preferably comprises at least one elevated part, so that upon rotation of the hub 30, the end of an arm 31 makes an up and down motion. The track 33 may for instance have a wavy configuration and/or have a main surface that is slightly inclined relative to the horizontal.

The radial arms in turn carry one or more seat supports 9 mounted directly (as shown) or via intermediate discs for eccentric rotation, having a plurality of seat positions arranged side by side and/or opposite and/or back-to-back relative to each other. The seats are rotatable about a transverse axis 14. The rotation about the axis 14 may be free or can be forced.

Figure 9:
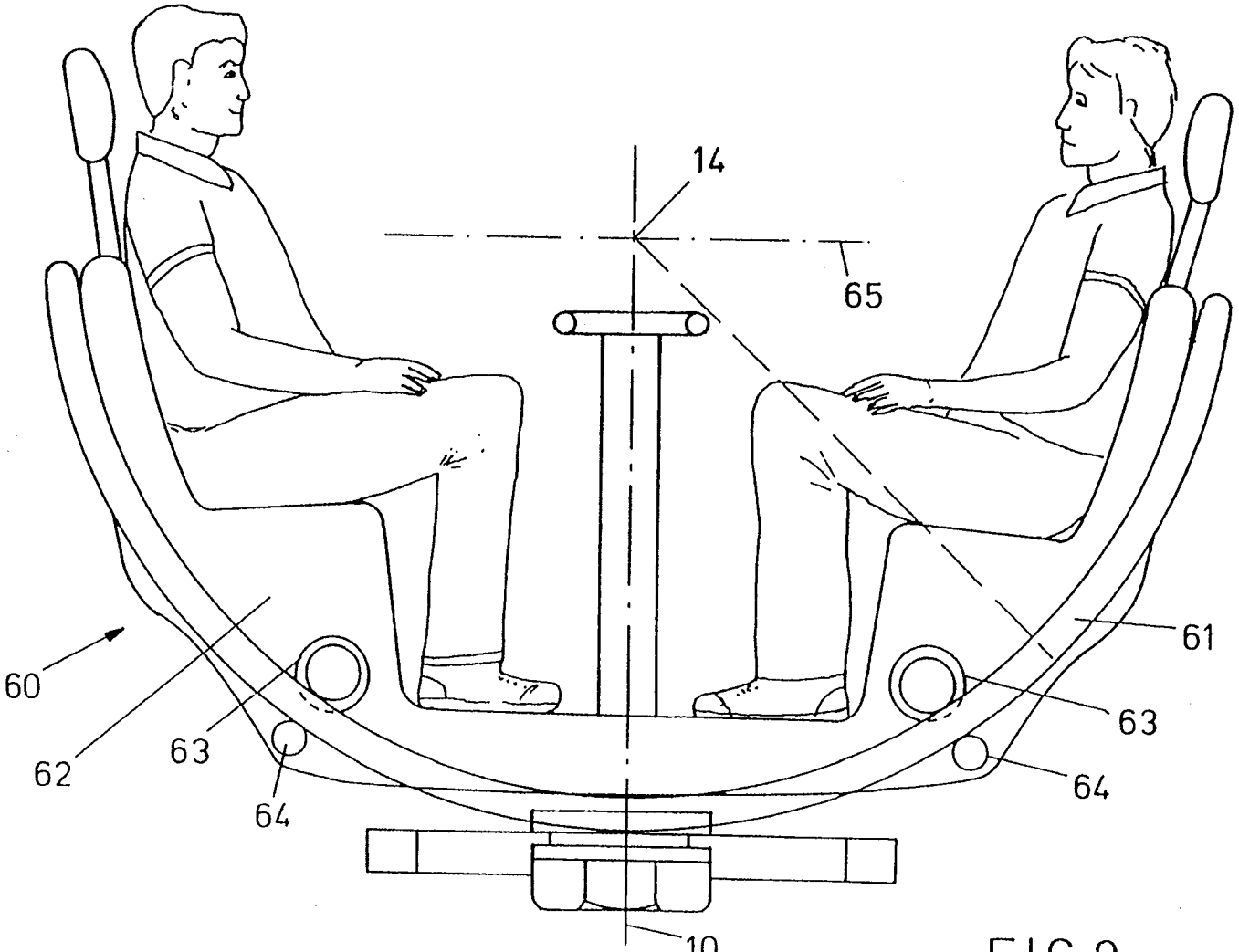

FIG. 9 schematically shows an embodiment of a seat support 60 comprising one or more arcuate guide means 61, for instance curved rails, of which in this embodiment the convex side is turned downwards. A seat 62, which in the present embodiment comprises a plurality of opposite seating positions, comprises travelling means, for instance travelling rollers or sliding rollers 63, cooperating with the arcuate guide means and which in operation can roll or slide or move otherwise along the guide means. In that case, the seat in face rotates again about an (imaginary) axis 14 extending transversely to the plane of the paper through the centre of the arcuate form of the guide means. Arranged opposite the rollers 61 are counter-rollers 64 or similar members resting against the exterior of the guide means and keeping the seat pressed against the guide means.

It is observed that after the foregoing various modifications of the embodiments shown are conceivable. Thus, the seats in the embodiments described are mounted in such a manner that the rocking motion about axis 14 occurs in forward and backward direction, from the viewpoint of the passengers. However, it is also possible to provide for a lateral rocking motion about an axis extending transversely to the axis 14. By way of example, FIGS. 7 and 9 show such an axis at 15 and 65. A combination of the two rocking motions can be obtained by means of a cardan suspension of the seats.

It is further noted that combinations of the various options in respect of motion and mounting of the seats and the seat supports are conceivable. If the rotation of the seat support or a seat is a motion driven by a motor, it is advantageous to use for this purpose a separate motor which is supplied via slip ring contacts at the bottom of the seat support. Such slip ring contacts are typically provided anyway for energizing lamps provided, for instance, on the backs of the seats. Such lamps are indicated by way of example at 66 in FIG. 12.

Further, the central axis, the axis of an intermediate disc and the second axis can be parallel, as in FIG. 1, but this is not necessary. Two of these axes or even all of these axes could be arranged at an angle relative to each other. These and similar modifications are considered to fall within the framework of the invention.

I claim:

1. In a fairground device having a plurality of seats comprising a base disc driven for rotation about a central axis and at least one seat support(s) mounted in spaced relation relative to the central axis for rotation about a second axis, each of the seat supports carrying at least one seat(s) mounted eccentrically relative to the corresponding second axis, the improvement comprising the seats mounted on the seat supports for rotation about at least one, third axis extending substantially transversely to the second axis.

2. A fairground device according to claim 1, wherein a base disc is provided with a plurality of intermediate discs mounted in spaced relation relative to the central axis for rotation about a fourth axis, each intermediate disc carrying the seat supports spaced from the fourth axis, said seat supports being rotatable eccentrically of the second axis, relative to the intermediate discs.

3. A fairground device according to claim 2, wherein drive means are provided for driving the intermediate discs.

4. A fairground device according to claim 2, wherein the base disc is constructed as a central hub having a plurality of radial arms each carrying at a free end thereof the seat supports.

5. A fairground device according to claim 4, wherein each radial arm carries an intermediate disc fitted with the seat supports.

6. A fairground device according to claim 2, wherein the intermediate discs are designed as an assembly of a hub and a plurality of radial arms each carrying the seat supports.

7. A fairground device according to claim 1, wherein drive means are provided for driving the seat supports for rotation about the second axis.

8. A fairground device according to claim 1, wherein drive means are provided for driving the seats for rotation about the third axis.

9. A fairground device according to claim 1, wherein the third axis permits a rotation of the seats in forward and backward direction with respect to the third axis.

10. A fairground device according to claim 1, wherein the third axis permits a rotation of the seats in lateral direction with respect to the third axis.

11. A fairground device according to claim 1, wherein the seats are further rotatable relative to corresponding seat supports about a further axis extending transversely to the third axis.

12. A fairground device according to claim 1, wherein the seat supports have at least one U-shaped part, and at least one seat is rotatably mounted between the legs of the U-shaped part.

13. A fairground device according to claim 1, wherein the seat supports have at least one T-shaped part, at least one seat being rotatably mounted on a transverse arm of the T-shaped part on opposite sides of an upright leg of the T-shaped part.

14. A fairground device according to claim 1, wherein the seat supports comprise at least one substantially arcuate guide means, the seats being provided with a plurality of counter guide means which can move along the guide means, the seats thereby performing a rocking motion.

15. A fairground device according to claim 1, wherein the seat supports comprise a first part carrying the seats that is spaced from a second part that supports the seats and has an orientation different from the first part, said first part comprising a hub rotatable about the second axis.

16. A fairground device according to claim 1, wherein the seats are provided with electric lamps.

17. A fairground device according to claim 16, wherein an electrical power supply for the electric lamps is obtained by slip ring contacts arranged around the second axis.

18. A fairground device according to claim 17, wherein the slip ring contacts also serve to supply electrical power to an electric motor, said electric motor driving at the rotation of the seats.

* * * * *